US011833825B2

(12) United States Patent
Lake

(10) Patent No.: US 11,833,825 B2
(45) Date of Patent: Dec. 5, 2023

(54) RETRACTABLE PRINTHEAD WIPER FOR PRINTHEAD MAINTENANCE UNITS

(71) Applicant: Xerox Corporation, Norwalk, CT (US)

(72) Inventor: Joshua Lake, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 151 days.

(21) Appl. No.: 17/384,238

(22) Filed: Jul. 23, 2021

(65) Prior Publication Data

US 2023/0021560 A1 Jan. 26, 2023

(51) Int. Cl.
*B41J 2/165* (2006.01)

(52) U.S. Cl.
CPC ..... *B41J 2/16538* (2013.01); *B41J 2/16544* (2013.01); *B41J 2/16585* (2013.01)

(58) Field of Classification Search
CPC . B41J 2/16538; B41J 2/16544; B41J 2/16585
See application file for complete search history.

(56) References Cited

U.S. PATENT DOCUMENTS

| | | | | |
|---|---|---|---|---|
| 5,570,117 | A | 10/1996 | Karambelas et al. | |
| 6,340,219 | B1 * | 1/2002 | Kumagai | B41J 2/16547 15/247 |
| 8,366,237 | B2 | 2/2013 | Phillips et al. | |
| 8,529,015 | B2 | 9/2013 | Williams et al. | |
| 9,676,196 | B1 | 6/2017 | Raoust | |

* cited by examiner

*Primary Examiner* — Geoffrey S Mruk
(74) *Attorney, Agent, or Firm* — Maginot Moore & Beck LLP

(57) ABSTRACT

A printhead maintenance system for a printing machine having at least one printhead, the system includes a body, at least one guide track supporting the body for movement along the at least one guide track in proximity to the face of the printhead, and a drive mechanism in engagement with the body and operable to move the body along the guide track. A wiper blade is movably mounted on said body for movement between a retracted position in which the wiper blade cannot contact the face of the printhead and an operative position in which the wiper blade can contact the face of the printhead. A biasing mechanism is provided between the wiper blade and the body that is configured to bias the wiper blade to the operative position. The system includes a retraction mechanism that is operable to move the wiper blade to the retracted position upon movement of the body along the guide track.

20 Claims, 15 Drawing Sheets

RETRACTABLE PRINTHEAD WIPER FOR PRINTHEAD MAINTENANCE UNITS

TECHNICAL FIELD

This disclosure is directed to inkjet printers that use staggered printhead arrays to form ink images on substrates and, more particularly, to the printhead maintenance units used in such printers for cleaning the nozzle plates of the printheads.

Inkjet printers have one or more printheads that eject drops of liquid material, referred to generally as ink, onto a substrate or previously ejected drops of material. Each printhead includes a plurality of inkjets typically arranged in an array. Each inkjet has a nozzle that communicates with an opening in a faceplate of the printhead to enable one or more drops of material to be ejected from the inkjet and through the opening with which the inkjet nozzle communicates in the faceplate. The inkjets can be implemented with a variety of different configurations known to those skilled in the art.

Some well-known configurations use piezoelectric and thermal ejectors in the inkjets. Some of the ink ejected from the inkjets adheres to the faceplate and can collect dust and other debris. If the ink and debris are not removed from the faceplate, then the residual ink and debris may block one or more openings in the faceplate. Printhead cleaning is typically performed within a maintenance station mounted within the printer chassis so the printhead and maintenance station can be moved relative to one another for cleaning. In some maintenance stations, an applicator wipes the faceplates of the printheads with a non-volatile solvent to liquefy the residual ink. Then, a pair of wipers move across the faceplates. The first wiper helps spread the solvent over the faceplate and loosen the debris from the faceplate. The second wiper separates the residual ink and the debris from the faceplate and moves the residual ink, debris, and solvent into a waste receptacle.

FIG. 1 illustrates one example of an aqueous ink image producing machine or printer 110 that directly forms an ink image on a surface of a web W of media pulled through the printer 110 by the controller 180' operating one of the actuators 140 that is operatively connected to a take up roll 146 mounted about the shaft. The printer can include a plurality of printheads 134A-134D, each including nozzles for ejecting low viscosity ink onto the web. The printheads are supplied by an aqueous ink delivery subsystem 120 that has at least one ink reservoir containing one color of aqueous ink. Since the illustrated printer 110 is a multicolor image producing machine, the ink delivery system 120 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of a purge system 124 are also operatively connected between the ink reservoirs and the printheads within the printhead modules to perform manifold and inkjet purges. Additionally, although not shown in FIG. 1, each printhead in a printhead module is connected to a corresponding waste ink tank with a valve configured to enable the manifold and inkjet purge operations. The printhead modules 134A-134D can include associated electronics for operation of the one or more printheads by the controller 180' although those connections are not shown to simplify the figure. Although the printer 110 includes four printhead modules 134A-134D, each of which has two arrays of printheads, alternative configurations include a different number of printhead modules or arrays within a module.

After an ink image is printed on the web W, the image passes under an image dryer 130. The image dryer 130 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer. As further shown, the media web W is unwound from a roll of media 138 as needed by the controller 180' operating one or more actuators 140 to rotate the take up roll 146 to pull the web from the media roll 138.

Operation and control of the various subsystems, components and functions of the machine or printer 110 are performed with the aid of a controller or electronic subsystem (ESS) 180'. The ESS or controller 180' is operably connected to the components of the ink delivery system 120', the purge system 124, the printhead modules 134A-134D (and thus the printheads), the actuators 140 and the heater 130. The ESS or controller 180', for example, is a self-contained, dedicated mini-computer having a central processor unit (CPU) with electronic data storage, and a display or user interface (UI) 150. The ESS or controller 180', for example, includes a sensor input and control circuit as well as a pixel placement and control circuit. In addition, the CPU reads, captures, prepares and manages the image data flow between image input sources, such as a scanning system or an online or a work station connection, and the printhead modules 134A-134D. As such, the ESS or controller 180' is the main multi-tasking processor for operating and controlling all of the other machine subsystems and functions, including the printing process.

Printhead maintenance is critical to maintain consistent performance of the printing machine. The purge system 124 is operable to purge the printheads of excess ink. A maintenance system 10 is used in conjunction with the purge system to collect the purged ink and debris. In addition, the maintenance system incorporates devices for cleaning the face of the printheads. In one typical system, a wiper blade is drawn across the face of the printhead to remove the debris and excess liquid after the purge operation.

In some printing machines, the printheads are in a "stitch" configuration or are staggered, as depicted in FIG. 2. Two printheads PH1, PH2 are shown with the successive printheads PH3, PH4 shown in phantom. The purge system 124 of the printer in FIG. 1 works in conjunction with a maintenance system that is used to remove debris and ink deposits from the printheads that can lead to degradation in performance and print quality. In current maintenance systems, a wiper blade, purge receptacle and surrounding structure all move together to move below a print bar for maintenance, draw the wiper blade across the jet stack of the printhead and then move away from a print bar during printing. For a print bar containing many printheads, the required size of the maintenance system is equal to or greater that than the length of the print bar. Consequently, more than half of the footprint of a large print system could be taken up by the maintenance system.

There is a need for a more compact maintenance system for performing maintenance on print bars incorporating many printheads.

SUMMARY

A new inkjet printer is provided with a new printhead maintenance system that includes a retractable wiper blade that can move across the jet stack or face of a printhead independently of the surrounding assembly of the maintenance system. This new wiping system allows the maintenance system to load in the process direction of the print bar because the wiper can move across the jet sack of the printhead independently in a direction orthogonal to the direction of the maintenance system loading. The required space for maintenance system storage is then approximately the length of the print bar in the process direction and not the full length of the print bar across all printhead jet stacks. As the number of printheads on a print bar increases for a given printing machine, the space savings increase.

In one aspect, a printhead maintenance system is provided for a printing machine having at least two rows of printheads parallel and near each other along the length of the printheads. The system includes two wiper assemblies, one each associated with a corresponding row of printheads. Each of the wiper assemblies includes a body, at least one guide track supporting the body for movement along the at least one guide track in proximity to the face of the printhead, and a drive mechanism in engagement with the body and operable to move the body along the at least one guide track. The wiper assemblies further include a wiper blade mounted on the body for movement between a retracted position in which the wiper blade cannot contact the face of the printhead and an operative position in which the wiper blade can contact the face of the printhead.

A biasing mechanism is provided between the wiper blade and the body that is configured to bias the wiper blade to the operative position. A retraction mechanism is provided that is operable to move the wiper blade to the retracted position upon movement of the body along the at least one guide track.

In one aspect, the drive mechanism includes an actuator, such as a stepper motor and a drive element, such as a lead screw, connected between the actuator and the body and operable to move the body along the at least one guide track by operation of the actuator. In another aspect, the biasing mechanism for each of the two wiper assemblies includes a blade mount rotatably mounted on the body, the blade mount carrying the wiper blade and rotatable between a first position in which the wiper blade is in the retracted position, and a second position in which the wiper blade is in the operative position. The biasing mechanism further includes a biasing spring between the blade mount and the body configured to bias the blade mount to the second position.

In one feature, the retraction mechanism for each of the two wiper assemblies includes an elongated support bracket fixed to the at least one guide track such that the body is movable relative to the support bracket, and a cam element fastened to the wiper blade and arranged to contact the support bracket to push the wiper blade to the retracted position upon movement of the body along the at least one guide track. The body of each of the two wiper assemblies includes a purge receptacle adjacent the wiper blade and configured for receiving liquids purged from the printhead as well as debris and liquids removed from the face of the printheads by the wiper assemblies.

It is contemplated that the maintenance system can include a single wiper assembly incorporating the features described herein, or more than two wiper assemblies to simultaneous service more than two rows of printheads.

BRIEF DESCRIPTION OF THE DRAWINGS

The foregoing aspects and other features of a system and method for wiping a printhead faceplate and an inkjet printer having a retractable wiper blade for faceplate cleaning are explained in the following description, taken in connection with the accompanying drawings.

DETAILED DESCRIPTION

Figure 1:
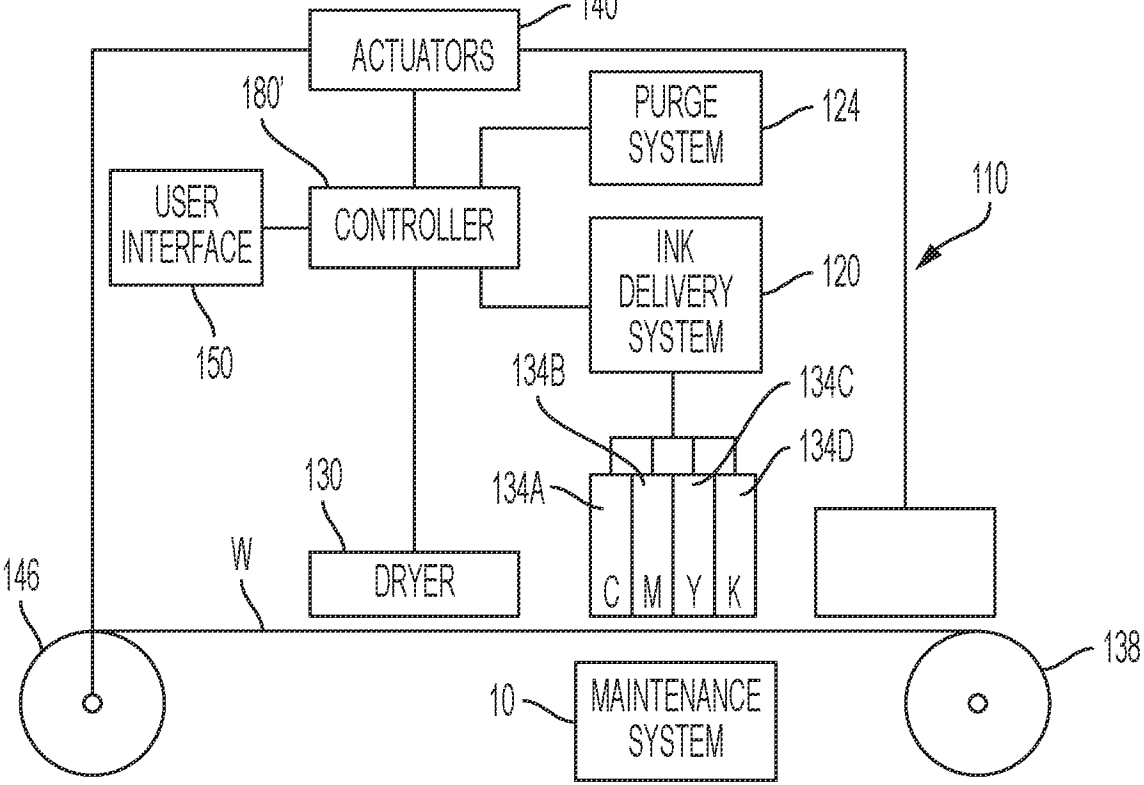
FIG. 1 is a schematic drawing of an aqueous inkjet printer that prints ink images directly to a web of media and that attenuates evaporation of fast drying inks from the printheads of the printer.

For a general understanding of the environment for the inkjet printer and its operation as disclosed herein, reference is made to the drawings. In the drawings, like reference numerals designate like elements.

Figure 2:
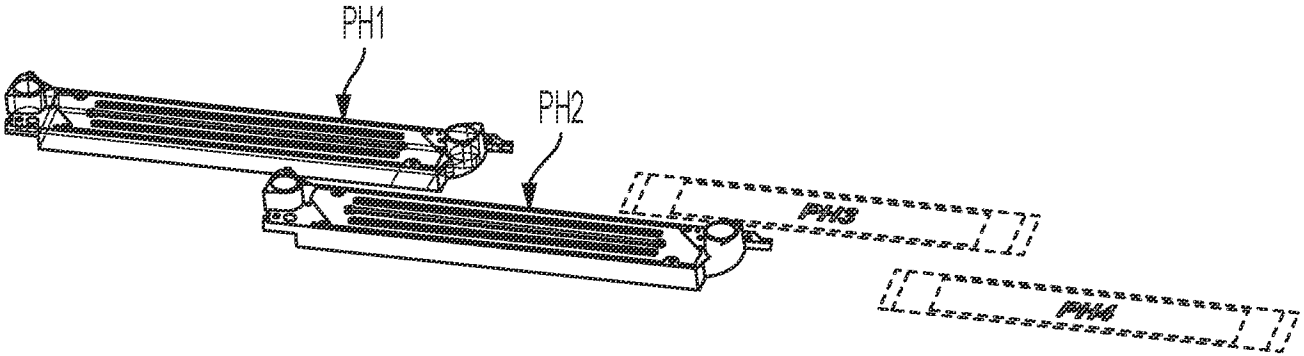
FIG. 2 is a perspective view of a print bar with multiple printheads in a stitched configuration.
Figure 3:
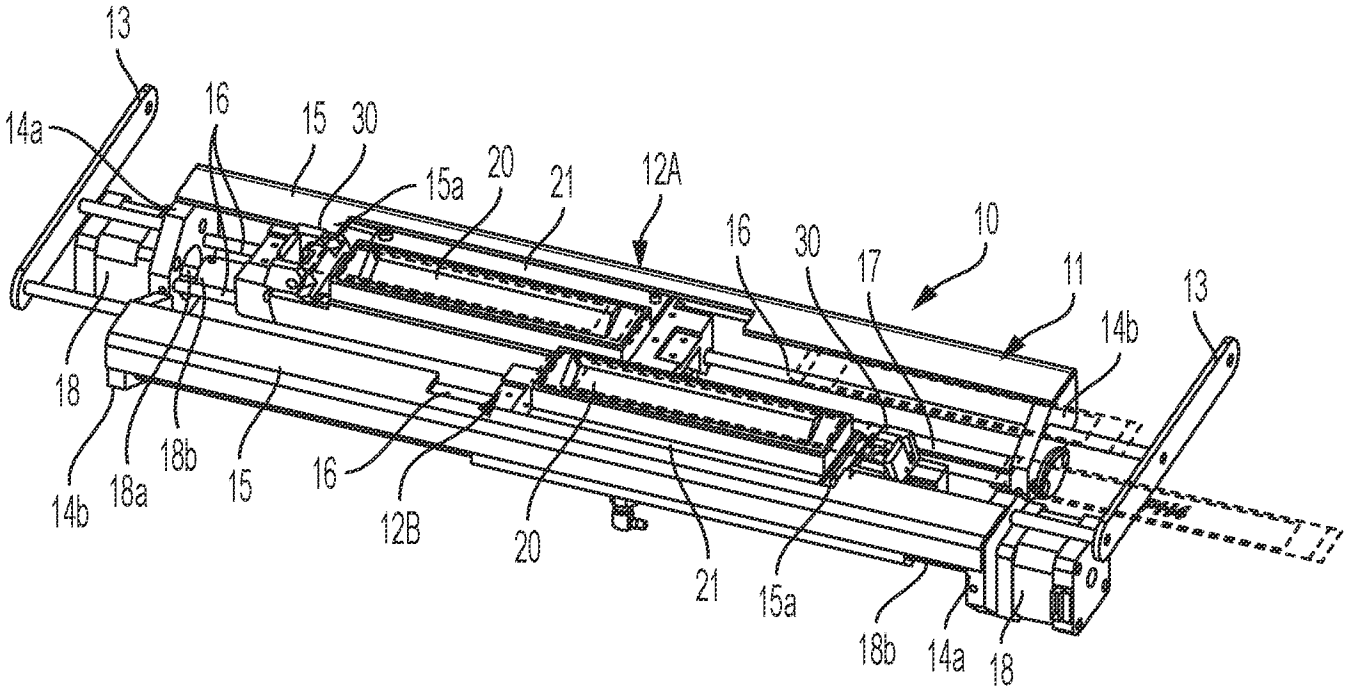
FIG. 3 is a perspective view of a maintenance system according to one embodiment of the present disclosure.

A maintenance assembly 10, shown in FIGS. 3-6, is configured to perform maintenance operations on the staggered printheads shown in FIG. 2. In particular, the assembly includes a first wiper assembly 12A arranged over the first row of printheads PH1, PH3, and a second wiper assembly 12B arranged over the second row of printheads PH2, PH4. The maintenance assembly can be configured to be removably mounted within the printing machine, such as the machine 110 described above, such as by mounting rails 13 configured to slide within corresponding brackets (not shown) in the printing machine. It is contemplated that the brackets that receive the mounting rails 13 are part of the overall printing machine maintenance assembly and are configured to be moved as necessary to orient the maintenance assembly 10 over a selected printhead or pair of printheads. It is understood that the printing machine is configured to hold the maintenance assembly 10 in a storage position apart from the printheads until a printhead maintenance procedure is requested. When maintenance is requested, the printing machine moves the mounting rails 13, and thus the entire maintenance assembly 10, to its operative position adjacent the face of the printheads being serviced.

The maintenance assembly 10 disclosed herein includes a frame structure 11 engaged between the mounting rails 13 and carrying two wiper assemblies 12A, 12B for simultaneously cleaning two printheads or rows of printheads. It should be understood that the maintenance assembly 10 can be modified to include only one wiper assembly depending on the maintenance need of the particular printing machine. The frame structure 11 includes support plates 14*a*, 14*b* that are engaged to the mounting rails. The support plates are configured to support a pair of guide tracks 16 for each pair of wiper assemblies, with the tracks extending between opposite support plates 14*a*, 14*b*. The support plate 14*a* for each wiper assembly supports an actuator 18, as part of a drive mechanism for the moving the wiper assembly along the guide tracks. In one embodiment the actuator is a stepper motor capable of incremental motion. The drive mechanism includes a drive element 17 extending between the actuator 18 at the support plate 14*a* and the opposite support plate 14*b*.

The frame structure 11 for the wiper assemblies includes a pair of support brackets 15, each extending between the support plates 14*a*, 14*b* for each wiper assembly. The support brackets 15 are arranged at the top of the wiper assemblies, between the wiper assemblies and the printheads when the maintenance assembly is in its operational position. The support brackets are also configured to flank the printhead when the maintenance assembly is in its operative position to perform maintenance on the printheads. In particular, when the maintenance assembly is in the operative position the printheads occupy the space between the two support brackets 15. The support brackets 15 each define an elongated cutout 15*a* that is essentially coextensive with the distance that the wiper assemblies must travel to clean one of the printheads PH1-PH4, or to clean a line of printheads, such as printheads PH1, PH3, or PH2, PH4.

Figure 4:
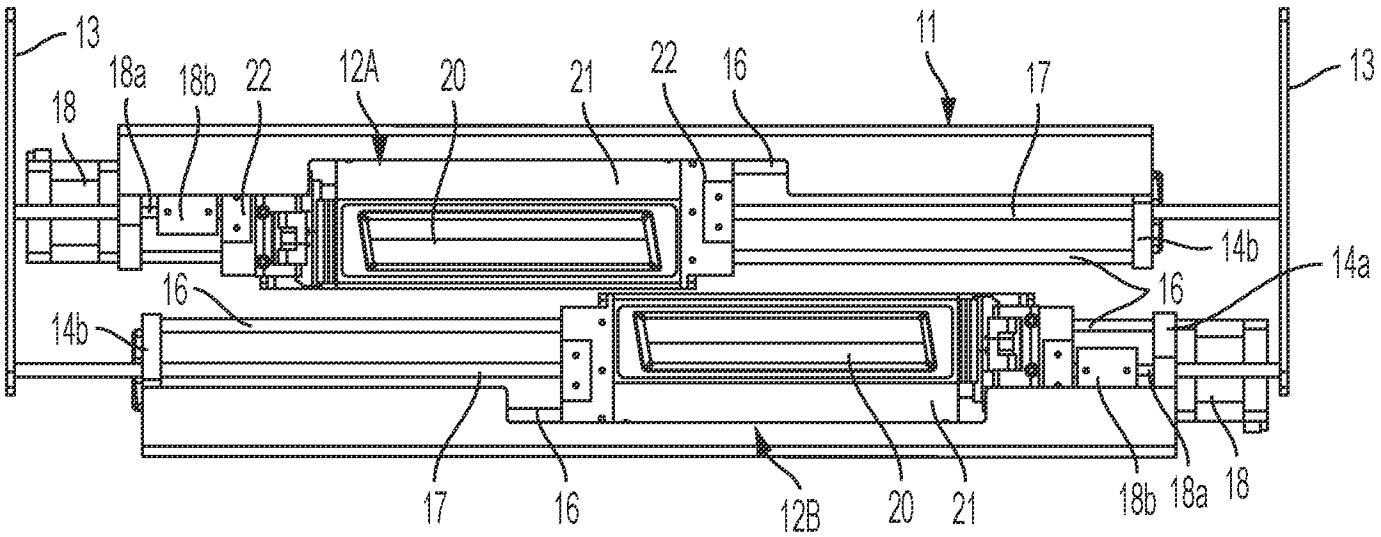
FIG. 4 is a top view of the maintenance system shown in FIG. 3.
Figure 5:
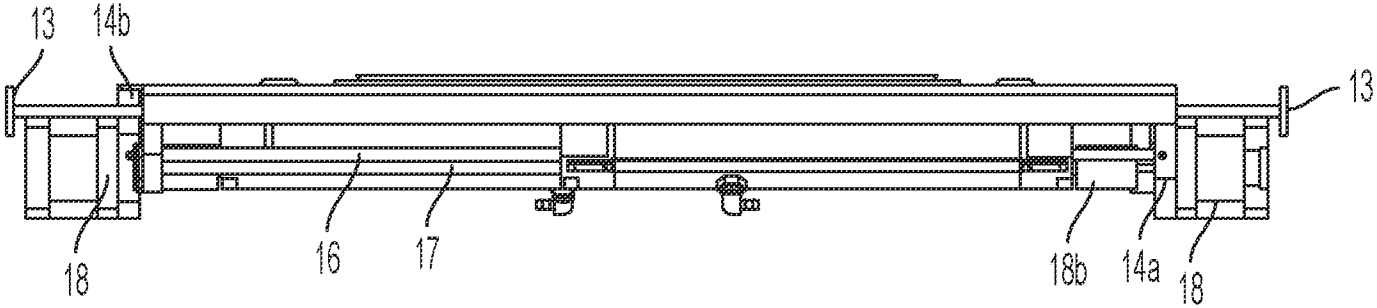
FIG. 5 is a side view of the maintenance system shown in FIG. 3.

Each wiper assembly 12A, 12B includes a body 21 that defines a purge receptacle 20 is sized and configured to receive the debris and ink expelled during operation of the purge system 124 (FIG. 1), as well as the debris scraped off the face of the printheads by the wiper assembly. The body 21 defines a pair of bearing mounts 22 at opposite ends of the body, as best seen in FIG. 4, 6. Each bearing mount includes a pair of spaced-apart bushings 23, each configured to receive a corresponding one of the guide tracks 16 extending therethrough. The bushings 23 allow the body 21 to slide smoothly from one end of the guide tracks at support 14*a* to the opposite end at support 14*b*.

The purge receptacle 20 is engaged to the actuator 18 through the drive element 17. In one embodiment, the drive element 17 is a threaded shaft or lead screw with external threads 17*a* configured to engage an internally threaded nut 28 fixed within the bearing mount 22. The end 17*b* of the drive element is engaged to the output shaft 18*a* of the actuator by an adaptor 18*b*. A pair of set screws 18*c* clamp the adaptor onto the two shafts. The opposite end of the drive element is rotatably supported in a support plate 14*b*. The actuator 18 can be a stepper motor configured to rotate the output shaft 18*a*, and thus the lead screw 17, in controllable amounts to precisely translate the purge receptacle 20. The threaded engagement between the nut 28 and the lead screw cases the nut, and thus the purge receptacle, to move along the length of the lead screw in a known manner. The drive element 17 propels the purge receptacle and the guide tracks 16 help stabilize the receptacle as it moves along the drive element.

In the illustrated embodiment, the body 21 of the purge receptacle 20 is supported by a pair of guide tracks 16. Other guide track configurations are contemplated, such as a single guide track that supports the body in conjunction with the drive element 17. In addition, in lieu of bushings 23 disposed in the bearing mount 22, the bearing mount can be formed of a low friction material with a pair of bores defined in the bearing mount to substitute for the separate bushings.

Figure 6:
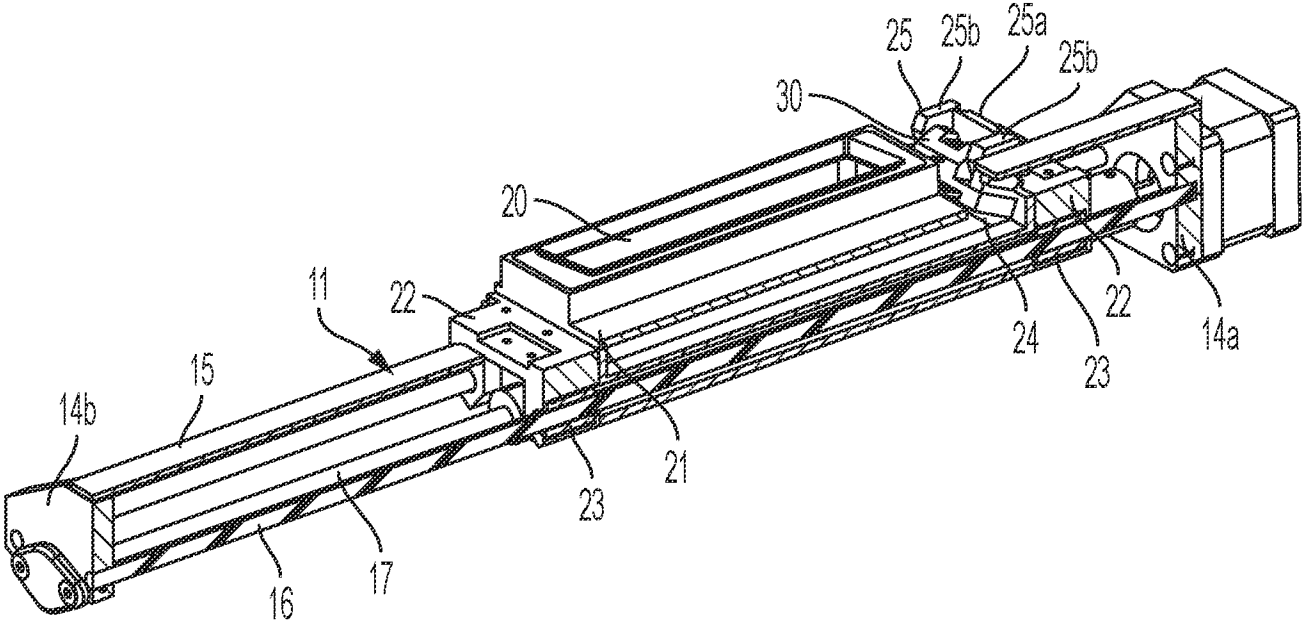
FIG. 6 is a cross-sectional view of the maintenance system shown in FIG. 3, with the cross-section taken along a guide rail of the system and with a retractable wiper in a first retracted position.
Figure 7:
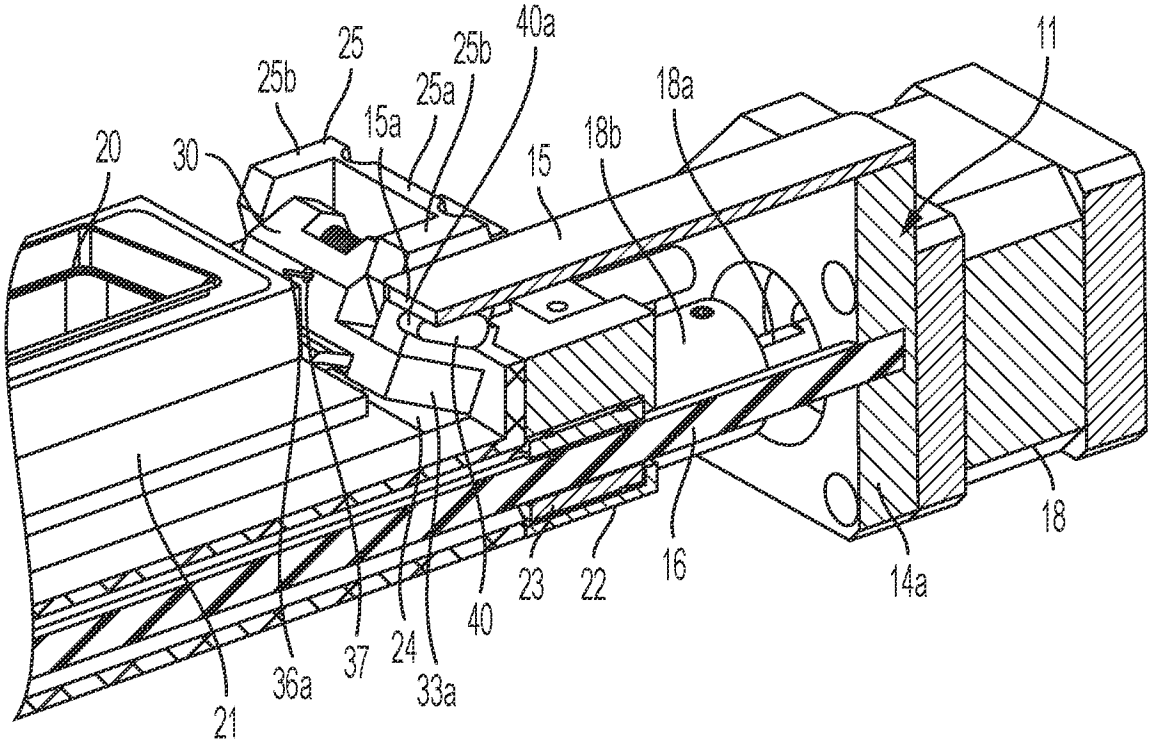
FIG. 7 is an enlarged view of the retractable wiper from the cross-sectional view of FIG. 6.
Figure 8:
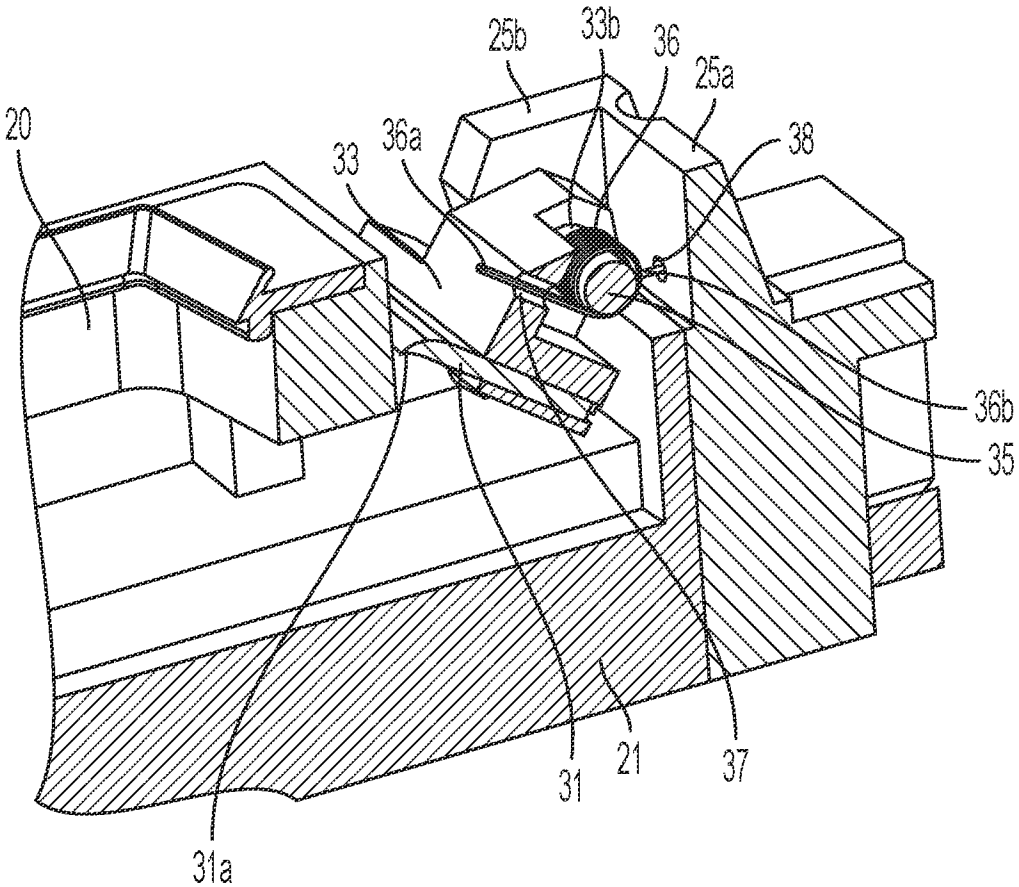
FIG. 8 is an enlarged cross-sectional view of the retractable wiper shown in FIG. 7, with the cross-section taken through the retractable wiper.
Figure 9:
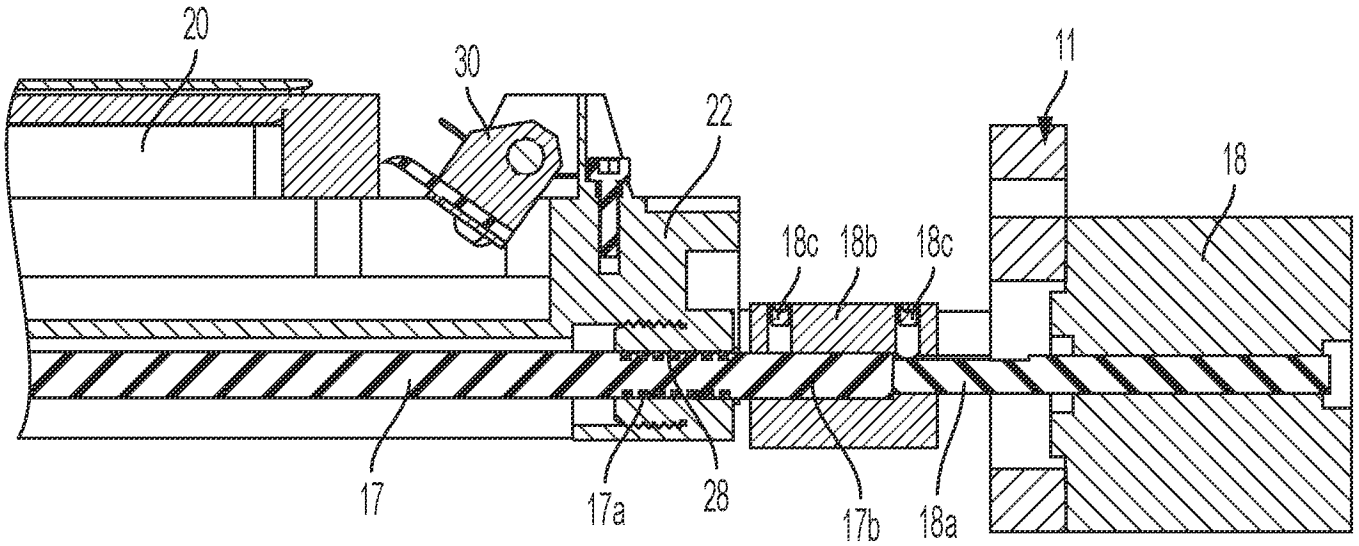
FIG. 9 is a cross-sectional view of the maintenance system shown in FIG. 3, with the cross-section taken along a drive element of the system and with the retractable wiper in the retracted position.
Figure 10:
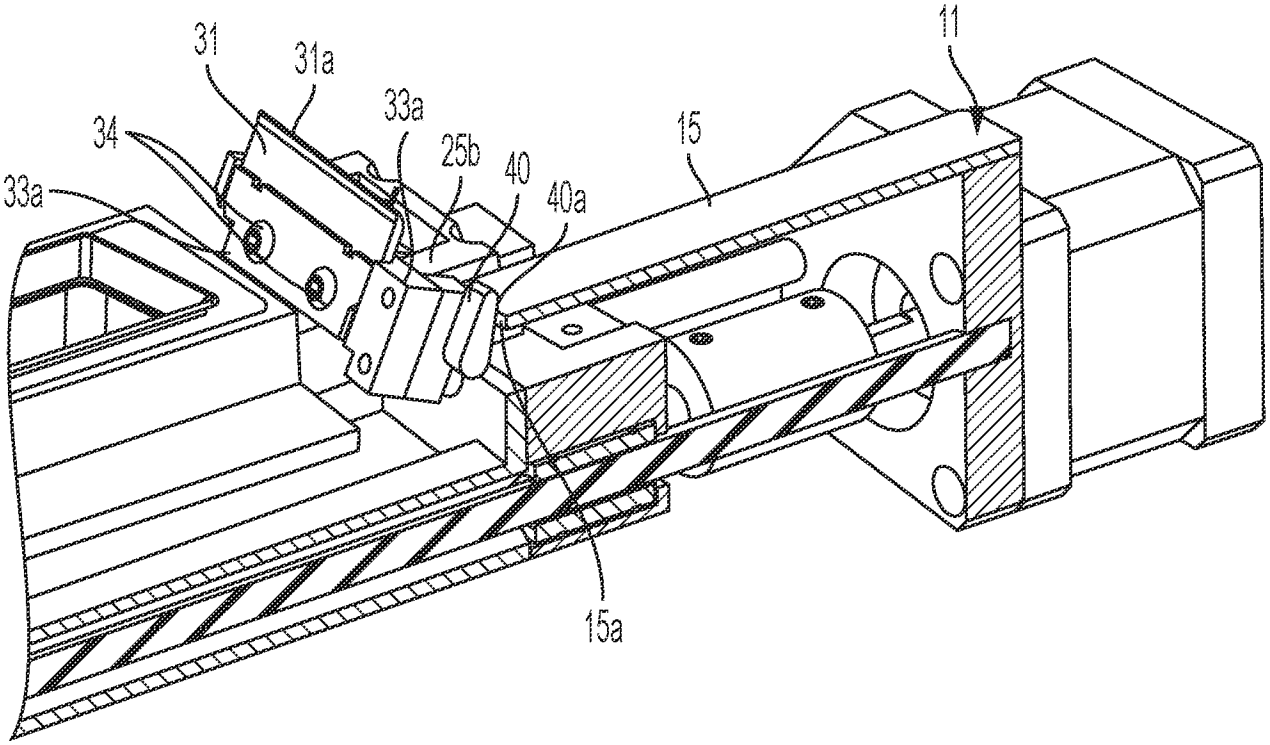
FIG. 10 is an enlarged view of the retractable wiper from FIG. 7 with the retractable wiper in a second intermediate extended position.
Figure 11:
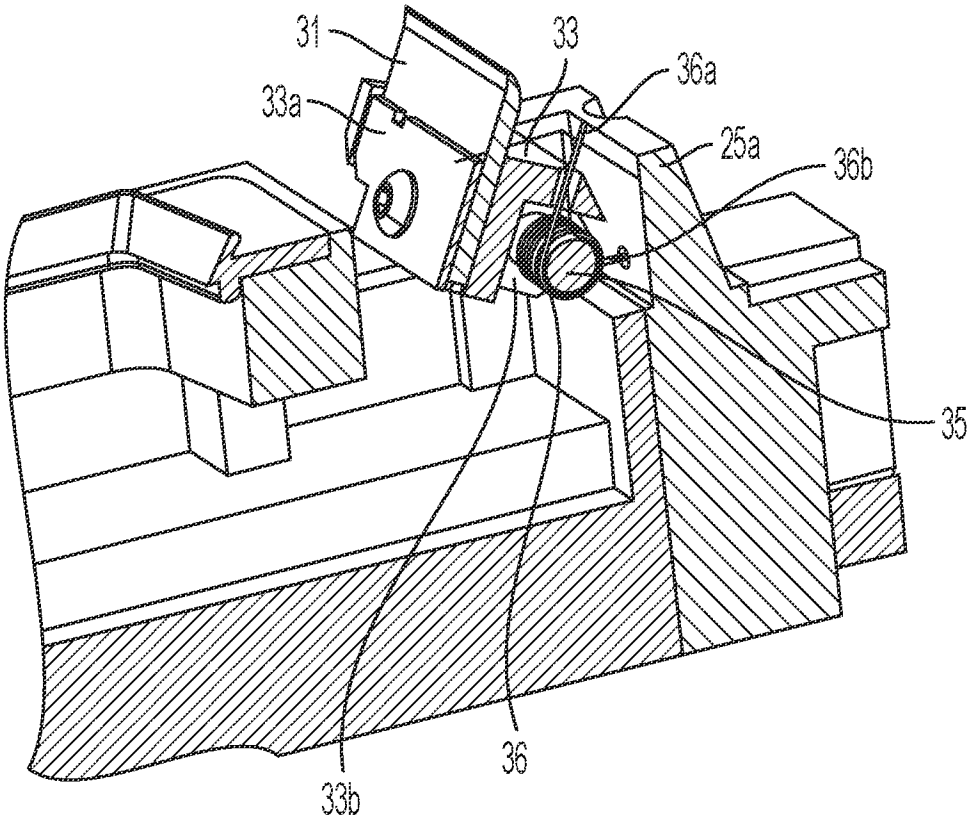
FIG. 11 is an enlarged view of the retractable wiper from FIG. 8 with the retractable wiper in the intermediate extended position.
Figure 12:
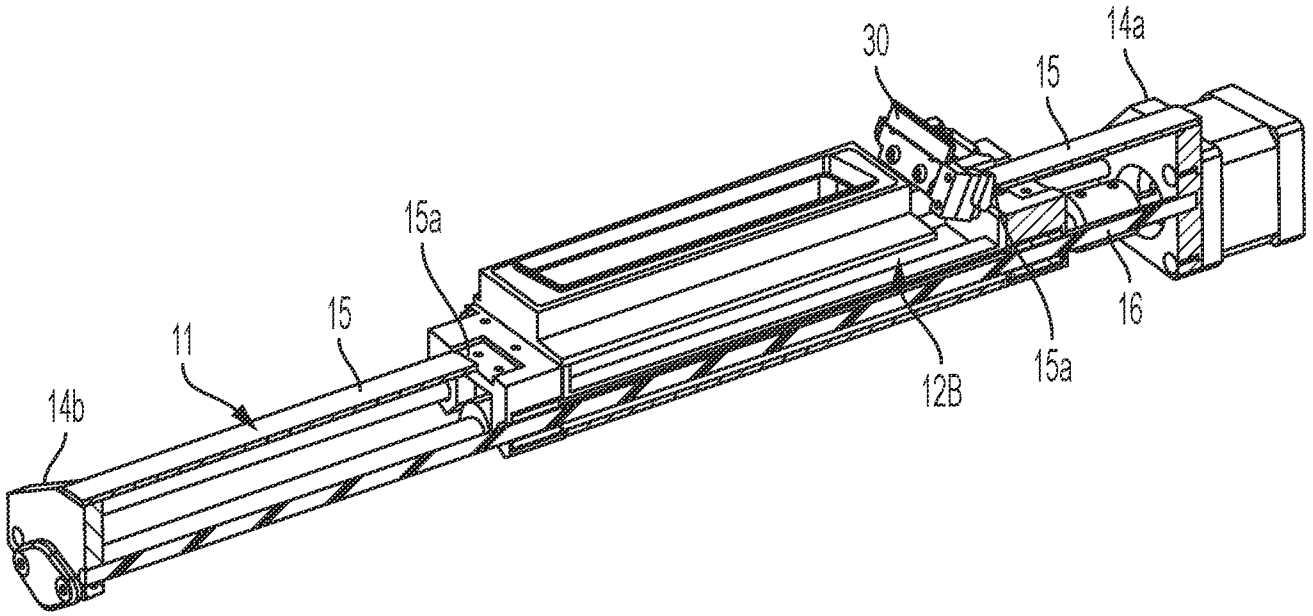
FIG. 12 is a cross-sectional view of the maintenance system shown in FIG. 3, with the cross-section taken along a guide rail of the system and with a retractable wiper in the intermediate extended position.

In one feature of the maintenance assembly 10, a retractable wiper 30 is associated with each purge receptacle 20. As shown in FIG. 6, the body 21 includes a wiper mounting region 25 immediately adjacent to one end of the receptacle 20. A mounting bracket 25 is associated with the bearing mount 22 and includes a base 25*a* with a pair of paced apart arms 25*b*, so that the mounting bracket is generally U-shaped. Referring to FIGS. 7-8 and 10, the retractable wiper 30 includes a blade 31 with a lip 31*a* that is configured to scrape debris and excess fluid from the surface of a printhead. The lip 31*a* is preferably formed of an elastomeric material capable of flexing under pressure without damaging the printhead. The blade 31 can be formed of the same elastomeric material or can incorporate a stiffer material, including a metal. The blade 31 is clamped within a blade mount 33 by a clamping plate 33*a* held by a pair of mounting bolts 34 (FIG. 10). The body 21 is configured and arranged on the guide tracks so that the purge receptacle 20 and the retractable wiper 30 are aligned with the printheads when the maintenance assembly is in its operative position to perform maintenance on the faces of the printheads.

An axle 35 extends through a bore 33*b* in the blade mount 33 and is anchored at the two arms 25*b* of the mounting bracket 25. The blade mount 33, and thus the wiper blade 31, is able to rotate about the axle 35 between a first stowed or retracted position shown in FIGS. 6-9 and a second intermediate extended position shown in FIGS. 10-13. The retractable wiper 30 is biased to the extended position by a torsion spring 36 mounted on the axle 35. One arm 36*a* of the torsion spring is engaged within a bore 37 defined in the blade munt 33, as shown in FIG. 8. The other arm 36*b* of the spring is engaged within a bore 38 defined in the mounting bracket 25. Thus, the arm 36*b* of the torsion spring acts as the anchor while the arm 36*a* is free to rotate about the axle 35, pulling the blade mount 33 and wiper blade 31 with it.

The retractable wiper 30 includes a retraction mechanism that automatically retracts the wiper blade 31 when the retractable wiper is a one end of the guide tracks 16, namely at the end engaged to the support plate 14*a*. The retraction mechanism includes a cam 40 affixed to the blade mount 33 by a bridge member 33*a* so that the cam is disposed outside one of the arms 25*b* of the mounting bracket 25, as shown in FIG. 7. The cam 40 includes a cam surface 40*a* that bears against the underside of the support bracket 15 immediately adjacent the cutout 15*a*. The cam 40 is arranged relative to the axle 35 and torsion spring 36 to operate against the spring when the cam 40 is pushed downward toward the wiper mounting region 24. Conversely, the torsion spring exerts a constant force to move or pivot the cam upward. In the position shown in FIG. 7, the support bracket 15 prevents the upward movement of the cam, and ultimately the upward rotation of the wiper blade 31, thereby maintaining the retractable wiper in its retracted position. However, when the cam 40 moves relative to the support bracket, the cam enters the cutout 15*a*, as shown in FIG. 10. In this position, the cam is no longer restrained by the support bracket and is thus free to move upward from the force of the torsion spring. Thus, the entire retractable wiper 30 is free to rotate upward so that the wiper blade 31 is in the operative position shown in FIGS. 10-13 in which the wiper can contact the face of the printhead. The retractable wiper 30 rotates until the bridge member 33*a* of the blade mount contacts the arm 25*b* of the bracket. The retraction mechanism is operable to retract the retractable wiper 30 when the body 21 is moved toward the support plate 14*a* and the cam 40 moves toward the cutout 15*a* until the cam surface 40*a* contacts the edge of the support bracket 15 at the cutout. Further movement of the body causes the support bracket to push against the cam surface to move the retractable wiper to its retracted position.

Figure 13:
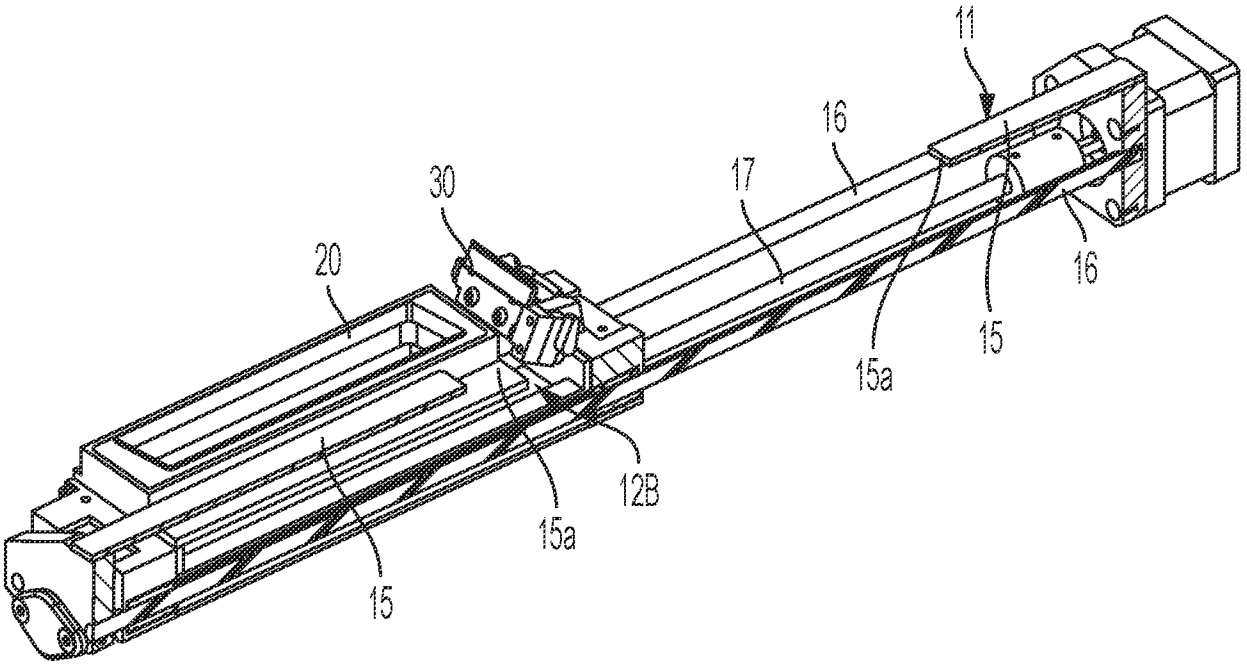
FIG. 13 is a cross-sectional view of the maintenance system shown in FIG. 3, with the cross-section taken along a guide rail of the system and with a retractable wiper in a third extended operative position.
Figure 14:
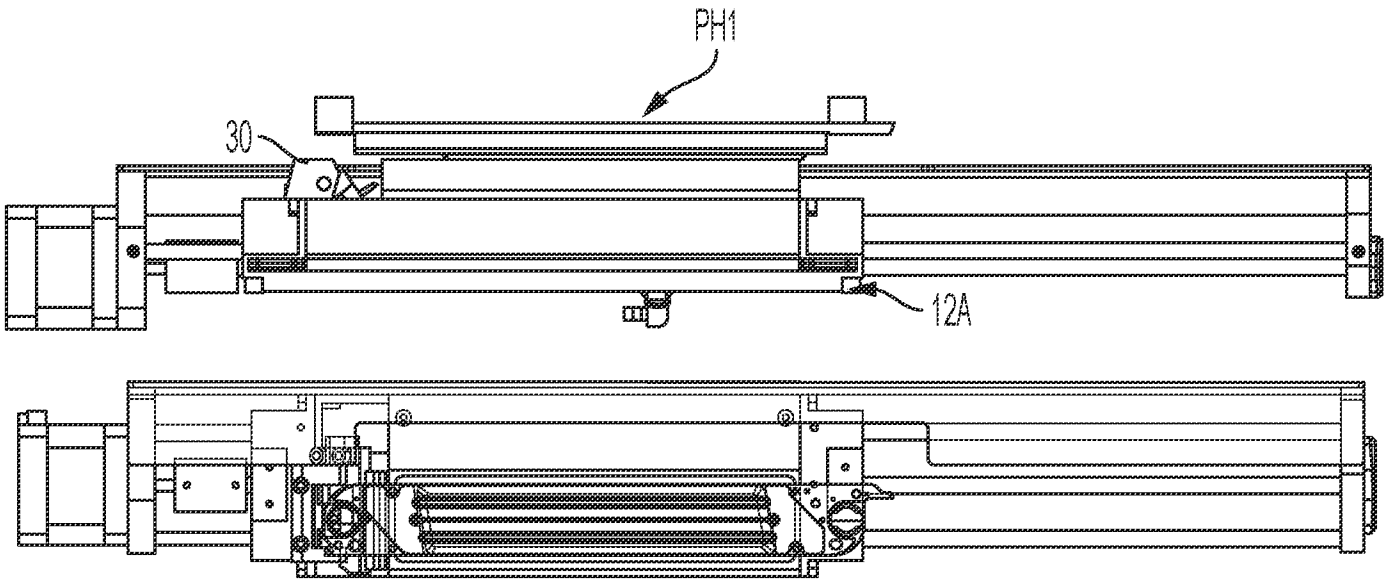
FIG. 14 are side and top view of the maintenance system of FIG. 3, with the retractable wiper in the retracted position.
Figure 15:
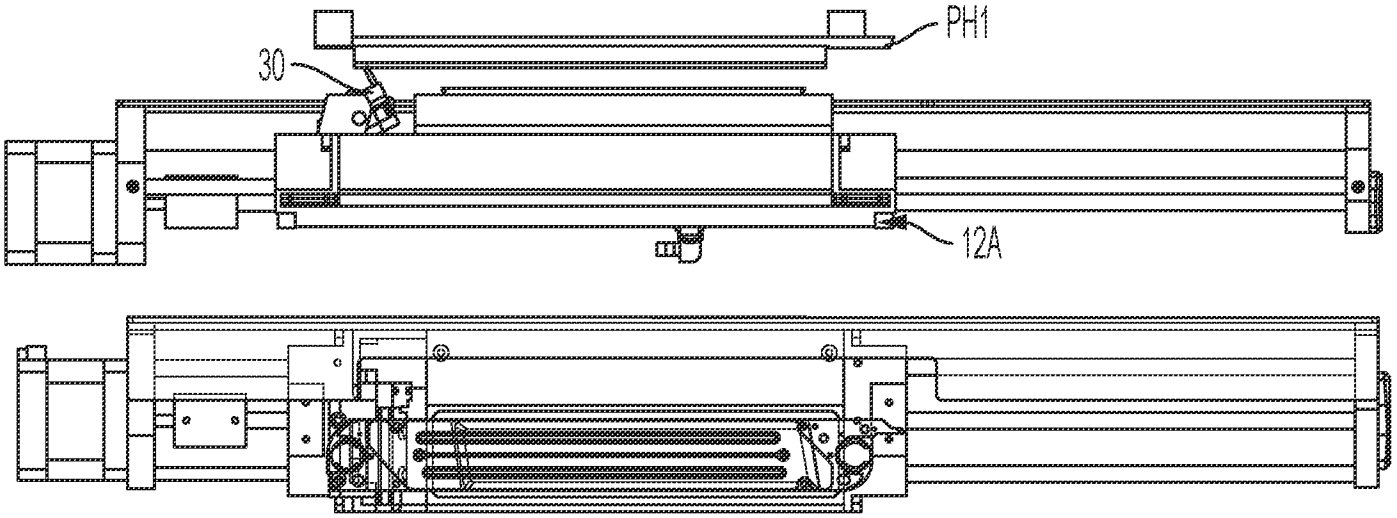
FIG. 15 are side and top view of the maintenance system of FIG. 3, with the retractable wiper in the intermediate extended position.
Figure 16:
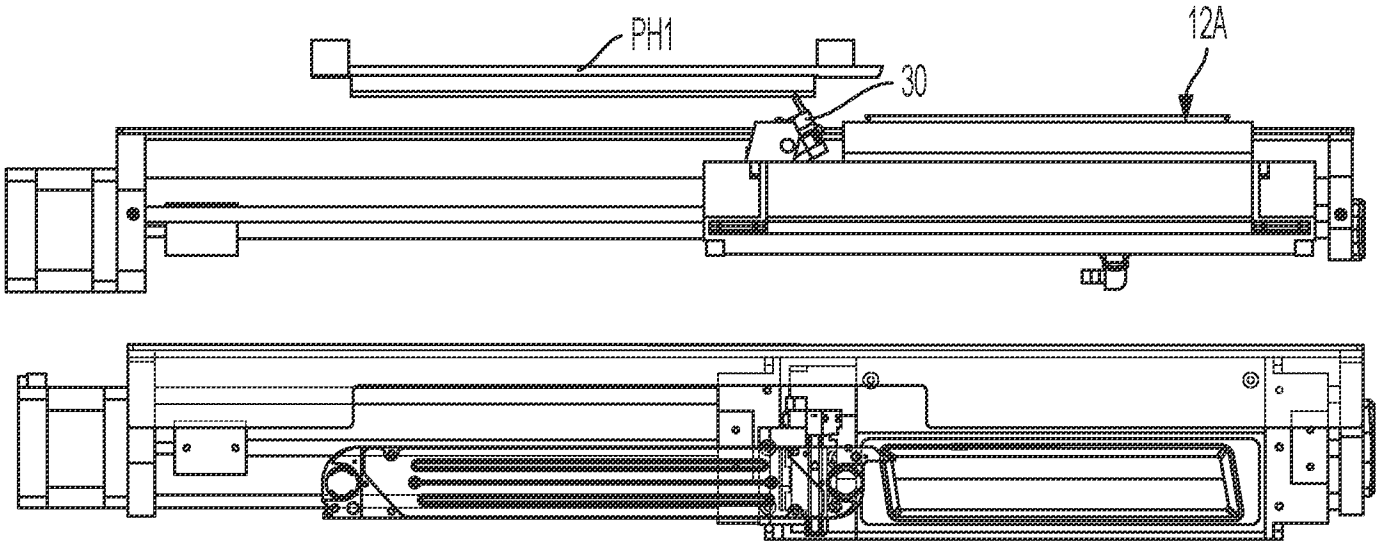
FIG. 16 are side and top view of the maintenance system of FIG. 3, with the retractable wiper in the extended operative position.

The retractable wiper 30 is moved from the retracted position of FIG. 7 to the extended position of FIG. 10, by operation of the actuator 18. In particular, rotation of the drive element 17 by the actuator interacts with the threaded nut 28 to move the body 21 longitudinally along the guide tracks 16. As the actuator continues to operate, the body 21 moves from one end of the cutout 15*a* to the opposite end of the cutout, as shown in FIG. 13. Thus, as shown in the sequence of FIGS. 14-16, the retractable blade 30 starts in is first retracted position, with the cam 40 held down by the support bracket 15, and then as the actuator drives the body 21 of the purge receptacle along the guide tracks, the retractable blade pivots upward into contact with the cutout 15*a* in the second intermediate extended position, and finally into contact with the printhead PH2 in the third extended position. The retractable blade remains in contact with the printhead PH2 as the body 21 of the purge receptacle continues to travel to the position shown in FIG. 16. It can be appreciated that the torsion spring 26 can have a spring force sufficient to constant pressure between the wiper blade 31, and particularly the lip 31*a*, and the face of the printhead PH2 as the wiper blade is drawn across the face of the printhead. It can further be appreciated that the amount of pivoting or rotation of the blade mount 33 is limited by contact with the arm 25*b* of the mounting bracket 25, with the amount of rotation calibrated so that the lip 31*a* contacts the printhead face at an optimum angle for cleaning the printhead.

When the retractable blade reaches the end of the cleaning stroke, the actuator is reversed, drawing the wiper assembly back to its starting retracted position. As the cam approaches the cutout 15*a* in the support bracket 15, the cam surface 40*a* contacts the support bracket, pushing the cam downward and rotating the blade mount 33 against the biasing force of the torsion spring 36. As the wiper blade 31 passes across the face of the printhead PH2, the debris and excess liquid is directed to the purge receptacle 20 for subsequent disposal.

In the illustrated embodiment, the wiper assemblies 12A, 12B are configured to operate in unison to clear the faces of staggered printheads PH1, PH2. The maintenance assembly 10 (FIG. 3) can then be shifted to align the two rows of wiper assemblies with the printheads PH3, PH4. Alternately, the wiper assemblies can be configured to travel across two printheads in a single stroke. In this alternative approach, the guide tracks 16 and drive element 17 would be lengthened to traverse printhead pair PH1, PH3 and PH2, PH4 (FIG. 2). It is further contemplated that the maintenance assembly 10 can be moved within the printing machine to other rows or pairs of rows of printheads in a multi-printhead machine, in a manner known in the art. The movement of the maintenance assembly between rows of printheads as well as the operation of the wiper assemblies 12A, 12B, and their associated actuators 18, can be controlled by a controller, such as the controller 180 (FIG. 1). The maintenance assembly is moved into its operative position prior to initiation of a purge cycle by the purge system 124 of the printing machine. Once the purge cycle is complete, the controller can activate the two wiper assemblies to complete the maintenance cycle for the particular printheads. The maintenance assembly 10 of the present disclosure can be integrated into a printing machine and operated to perform maintenance on printheads in a manner similar to that described in U.S. Pat. No. 8,529,015, which issued to the present applicant on Sep. 10, 2013, or in U.S. Pat. No. 8,366,237, which issued to applicant on Feb. 5, 2013, the disclosures of which are incorporated herein by reference.

The retractable wiper 30 of the present disclosure utilizes a biasing element to bias the wiper blade 31 into contact with the face of the printhead during a cleaning stroke. The wiper assemblies 12A, 12B are also configured to push the respective retractable wiper into the retracted position against the force of the biasing element when the wiper assemblies are in a purge position. In this position, the printheads are purged to drive excess liquid (ink) from the printhead into the purge receptacles 20. The wiper blade 31 is retracted to protect it from the heated liquid during the purge process. Once the purge process is complete, the actuator 18 drives the wiper assemblies across the printheads, with the wiper blade extending into contact with the printhead face.

In the illustrated embodiment, the biasing element is the torsion spring 36 that is configured to generate a torque to rotate the retractable wiper 30 to its extended, active position. In an alternative embodiment, the biasing element can be one or more compression springs disposed between the wiper mounting region 24 and the blade mount 33, with the compression springs biased to rotate the retractable wiper about the axle in the same manner as the torsion spring. Even in this configuration, the interaction between the cam 40 and the support bracket cutout 15*a* pushes the retractable wiper against the spring force to its retracted position.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printhead maintenance system for a printing machine having at least one printhead, the system comprising:

a body;

at least one guide track supporting said body for movement along the at least one guide track in proximity to the face of the printhead;

a drive mechanism in engagement with said body and operable to move the body along the at least one guide track;

a wiper blade movably mounted on said body, said wiper blade moveable between a retracted position in which the wiper blade cannot contact the face of the printhead and an operative position in which the wiper blade can contact the face of the printhead;

a biasing mechanism between said wiper blade and said body configured to bias said wiper blade to said operative position; and a retraction mechanism operable to move said wiper blade to said retracted position upon movement of said body along said at least one guide track.

2. The printhead maintenance system of claim 1, wherein said biasing mechanism includes:

a blade mount rotatably mounted on said body, said blade mount carrying said wiper blade, said blade mount rotatable between a first position in which said wiper blade is in said retracted position, and a second position in which said wiper blade is in said operative position; and a biasing spring between said blade mount and said body configured to bias said blade mount to said second position.

3. The printhead maintenance system of claim 2, wherein said biasing mechanism includes:

a mounting bracket mounted on said body; and an axle engaged to said mounting bracket and rotatably supporting said blade mount, wherein said biasing spring is a torsion spring mounted on said axle and having a first leg engaged to said blade mount and a second leg engaged to said mounting bracket.

4. The printhead maintenance system of claim 1, wherein said retraction mechanism includes:

an elongated support bracket fixed to said at least one guide track such that the body is movable relative to said support bracket;

a cam element fastened to said wiper blade and arranged to contact said support bracket to push said wiper blade to said retracted position upon movement of said body along said at least one guide track.

5. The printhead maintenance system of claim 4, wherein said support bracket defines a cut-out along the length thereof, said cut-out being substantially co-extensive with the length of the printhead.

6. The printhead maintenance system of claim 1, wherein said drive mechanism includes:

an actuator connected to one end of said at least one guide track; and a drive element connected between said actuator and said body and operable to move said body along the at least one guided track by operation of said actuator.

7. The printhead maintenance system of claim 6, wherein:

said actuator is a motor with a rotating output shaft;

said drive element is a lead screw connected to said rotating output shaft for rotation therewith by operation of said motor; and said body includes a threaded nut fixed thereto and in threaded engagement with said lead screw so that rotation of said lead screw causes movement of said body along the at least one guided track.

8. The printhead maintenance system of claim 1, further comprising a frame structure mountable in the printing machine and fixed in relation to said body and said wiper blade, said frame structure, including said at least one guide track.

9. The printhead maintenance system of claim 8, wherein said frame structure includes:

pair of mounting rails mountable in the printing machine; and a pair of spaced apart support plates, said at least one guide track connected at its opposite ends to a corresponding one of said support plates, and said drive mechanism connected between one of said support plates and said body.

10. The printhead maintenance system of claim 9, wherein said drive mechanism includes:

an actuator connected to said one of said support plates; and a drive element connected between said actuator and said body and operable to move said body along the at least one guide track by operation of said actuator.

11. The printhead maintenance system of claim 1, wherein body includes a purge receptacle adjacent said wiper blade and configured for receiving liquids purged from the printhead.

12. A printhead maintenance system for a printing machine having at least two rows of printheads parallel and near each other along the length of the printheads, the system comprising:

two wiper assemblies, one each associated with a corresponding row of printheads, each wiper assembly including;

a body;

at least one guide track supporting said body for movement along the at least one guide track in proximity to the face of the printhead;

a drive mechanism in engagement with said body and operable to move the body along the at least one guide track;

a wiper blade movably mounted on said body, said wiper blade moveable between a retracted position in which the wiper blade cannot contact the face of the printhead and an operative position in which the wiper blade can contact the face of the printhead;

a biasing mechanism between said wiper blade and said body configured to bias said wiper blade to said operative position; and a retraction mechanism operable to move said wiper blade to said retracted position upon movement of said body along said at least one guide track.

13. The printhead maintenance system of claim 12, further comprising a frame structure mountable in the printing machine and fixed in relation to said body and said wiper blade of each of said two wiper assemblies, said frame structure, including said at least one guide track of each of said two wiper assemblies.

14. The printhead maintenance system of claim 13, wherein said frame structure includes:

pair of mounting rails mountable in the printing machine; and for each of said two wiper assemblies, a pair of spaced apart support plates, said at least one guide track connected at its opposite ends to a corresponding one of said support plates, and said drive mechanism connected between one of said support plates and said body.

15. The printhead maintenance system of claim 14, wherein said drive mechanism includes:

an actuator connected to said one of said support plates; and a drive element connected between said actuator and said body and operable to move said body along the at least one guide track by operation of said actuator.

16. The printhead maintenance system of claim 12, wherein said biasing mechanism for each of said two wiper assemblies includes:

a blade mount rotatably mounted on said body, said blade mount carrying said wiper blade, said blade mount rotatable between a first position in which said wiper blade is in said retracted position, and a second position in which said wiper blade is in said operative position; and a biasing spring between said blade mount and said body configured to bias said blade mount to said second position.

17. The printhead maintenance system of claim 12, wherein said drive mechanism of each of said two wiper assemblies includes:

an actuator connected to one end of said at least one guide track; and a drive element connected between said actuator and said body and operable to move said body along the at least one guided track by operation of said actuator.

18. The printhead maintenance system of claim 17, wherein:

said actuator is a motor with a rotating output shaft;

said drive element is a lead screw connected to said rotating output shaft for rotation therewith by operation of said motor; and said body includes a threaded nut fixed thereto and in threaded engagement with said lead screw so that rotation of said lead screw causes movement of said body along the at least one guided track.

19. The printhead maintenance system of claim 12, wherein said body of each of said two wiper assemblies includes a purge receptacle adjacent said wiper blade and configured for receiving liquids purged from the printhead.

20. A printhead maintenance system for a printing machine having at least two rows of printheads parallel and near each other along the length of the printheads, the system comprising:

two wiper assemblies, one each associated with a corresponding row of printheads, each wiper assembly including;

a body;

at least one guide track supporting said body for movement along the at least one guide track in proximity to the face of the printhead;

a drive mechanism in engagement with said body and operable to move the body along the at least one guide track;

a wiper blade movably mounted on said body, said wiper blade moveable between a retracted position in which the wiper blade cannot contact the face of the printhead and an operative position in which the wiper blade can contact the face of the printhead;

a biasing mechanism between said wiper blade and said body configured to bias said wiper blade to said operative position; and a retraction mechanism operable to move said wiper blade to said retracted position upon movement of said body along said at least one guide track, wherein said retraction mechanism includes, wherein said retraction mechanism for each of said two wiper assemblies includes;

an elongated support bracket fixed to said at least one guide track such that the body is movable relative to said support bracket;

a cam element fastened to said wiper blade and arranged to contact said support bracket to push said wiper blade to said retracted position upon movement of said body along said at least one guide track.

* * * * *